US006142137A

United States Patent [19]

MacLaughlin

[11] Patent Number: 6,142,137

[45] Date of Patent: Nov. 7, 2000

[54] TRIGGER CONTROL SYSTEM FOR A PAINT BALL GUN

[76] Inventor: Edwin J. MacLaughlin, 1033 Elm St., Hopewell, Va. 23860

[21] Appl. No.: 09/334,405

[22] Filed: Jun. 16, 1999

[51] Int. Cl.[7] ..... F41B 11/06; F41Z 19/00

[52] U.S. Cl. ..... 124/72; 124/77; 124/32; 42/84

[58] Field of Search ..... 124/72, 77, 70, 124/71, 73, 74, 75, 19, 31, 32, 33, 34; 42/84

[56] References Cited

U.S. PATENT DOCUMENTS

| | | | |
|---|---|---|---|
| 4,329,803 | 5/1982 | Johnson et al. | 42/84 |
| 4,770,153 | 9/1988 | Edelman | 124/72 |
| 5,413,083 | 5/1995 | Jones | 124/32 |
| 5,503,137 | 4/1996 | Fusco | 124/72 |
| 5,722,383 | 3/1998 | Tippmann, Sr. et al. | 124/76 |
| 5,727,538 | 3/1998 | Ellis | 124/77 |
| 5,791,325 | 8/1998 | Anderson | 124/56 |
| 5,890,479 | 4/1999 | Morin | 124/31 |
| 5,954,507 | 9/1999 | Rod et al. | 434/19 |

*Primary Examiner*—Charles T. Jordan
*Assistant Examiner*—James S. Bergin
*Attorney, Agent, or Firm*—Norman B. Rainer

[57] ABSTRACT

A system for controlling the firing of a paint ball gun includes an electromechanical device (EMD) that produces linear motion interactive with the conventional trigger of the gun. Electronic circuitry produces pulses that activate the EMD. The pulses are based upon control signals produced by either the timing of paint balls entering the firing chamber of the gun or the detection of the presence of a single paint ball within the chamber. A manually operated electrical switch trigger activates the electronic circuitry. An adjustably predetermined number of paint balls will fire based upon each depression of the electrical switch trigger while minimizing the chopping of paint balls in the firing chamber.

14 Claims, 3 Drawing Sheets

TRIGGER CONTROL SYSTEM FOR A PAINT BALL GUN

BACKGROUND OF THE INVENTION

1. Field of the Invention

This invention pertains generally to paint ball guns used for recreational and training purposes. For the purposes of this disclosure, paint ball guns are specifically defined as apparatus that propel capsules filled with paint from a barrel in rapid succession and at relatively high speeds. The paint ball capsules are designed to break upon impact with an object or person, thereby rendering an identifiable mark without injuring the person or object.

2. Description of the Prior Art

Paint ball guns employ a compressed gas as the propellant to fire a paint-filled projectile called a "paint ball" or a pellet. The paint balls are of spherical shape having a fragile outer shell, and are designed to break on its target and thus deliver its paint to the target surface. Most paint ball guns are of single shot or semi-automatic design, but are capable of firing in rapid succession a relatively large number of paint balls in a short period of time. However, it is desirable to be able to control the firing to single shots, bursts of a predetermined number of shots, and full automatic, namely continuous firing as quickly as the gun is capable of with a single depression of the trigger.

Mechanisms have earlier been disclosed for converting a semi-automatic gun to fully automatic. A problem though, with fully automatic or rapid semi-automatic firing is that the gun fires too fast. Firing too fast is painful to the victim who gets hit with a multitude of paint pellets rather than just one or two. Firing too fast also wastes ammunition and, in the case of $CO_2$ activated guns, cools down the gun, causing slower gas expansion, which causes a low pellet velocity. Lower velocity means shorter effective gun range and accuracy. Also, a slower moving paint pellet will bounce off an opponent rather than breaking and marking the opponent. The cooled gun also may not give enough velocity to the recoiling bolt for the bolt to latch, causing repeated uncontrolled firing of the gun (cycling) even when the trigger is released. As the rate of firing increases, there is increased incidence of "chopping" or rupture of the paint balls, as will be discussed further hereinafter.

Paint ball guns generally comprise a reciprocating pneumatic bolt confined within a bolt housing coupled to a rifle barrel by means of a receiver. A magazine for supplying paint balls is coupled to the junction of the bolt housing and barrel at the receiver. In operation, a gas such as air, $CO_2$ or $N_2$ at a pressure substantially above atmospheric pressure drives the bolt forwardly. The impact of the bolt and the pressure of the gas propel the paint ball through the barrel. The flow of high pressure gas to the bolt is generally regulated by a mechanically controlled pneumatic system.

Paint ball magazines are little more than hoppers positioned atop the gun with a feed tube descending to communication with the receiver. The paint pellets are simply poured into the hopper, which typically holds from 60 to 200 pellets, and is easily reloaded by pouring in more pellets as needed. The pellets fall by gravity sequentially into the receiver forwardly of the bolt. Guns and attachments have now been designed to help this gravity feed by using gas expansion to push the new pellet into the chamber quicker than gravity alone. These feeding improvements still are not fast enough or exacting enough to reliably keep up with a typical full auto rate of fire or a "double pull" wherein the trigger is manually pulled faster than a successive ball can be properly seated. Attempting to shoot a semi-automatic gun at extremely fast rates will cause the gun to fire before the pellet has completely entered the firing chamber, causing the pellet to jam or burst inside the gun. Additionally, the slight jerking of a semi auto gun while rapidly pulling the trigger causes a distinct loss of aiming accuracy.

U.S. Pat. No. 5,791,325 to Anderson concerns a paint ball gun having a positive feed mechanism associated with a hopper-type magazine to minimize jamming of the gun.

U.S. Pat. No. 4,770,153 to Edelman discloses a pneumatic weapon having a series of built-in valves and regulators whereby the electronic pulses produce single, burst or continuous fire.

U.S. Pat. No. 5,727,538 to Ellis concerns an air gun that is loaded and fired electronically. The chopping of paint balls is minimized through the use of sensors which detect the location of the paint balls and position of the bolt within the receiver mechanism. A selector switch permits full automatic, three-round burst, or semi-automatic firing.

U.S. Pat. No. 5,413,083 to Jones describes an attachment for a paint ball gun which adapts the gun to fire in automatic, semi-automatic and other patterns of fire. Said attachment has a mechanical mechanism for manipulating a protrusion of the gun, such as a bolt handle, a programmable pulse generator for determining the pattern of fire, and an electromechanical device for converting the signals generated by the pulse generator into a mechanical motion for driving the mechanical mechanism which manipulate the bolt handle.

Although the aforesaid patents address the issues of minimizing ball chopping, and providing selectable firing patterns, they generally require factory-specialized construction at the time of manufacture of the gun. The Jones attachment, although useful as an add-on or after-market feature, is bulky, and is suitable only for guns having a particular bolt configuration.

It is accordingly an object of the present invention to provide a system for controlling the firing pattern of a paint ball gun.

It is a further object of this invention to provide a control system as in the foregoing object which can be installed onto an existing paint ball gun.

It is another object of the present invention to provide a control system of the aforesaid nature of compact size and interactive with the trigger of the gun.

It is a still further object of this invention to provide a control system of the aforesaid nature which will minimize the chopping of paint balls.

It is yet another object of the present invention to provide a system of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a system for controlling the firing of a paint ball gun having a forestock, a firing chamber, a conventional trigger, and a gripping portion adjacent said trigger, said system comprising:

a) an electromechanical device (EMD) that produces linear reciprocating motion based upon energizing pulses of electrical current, and adapted to interact with said trigger in a reciprocating manner to actuate the firing of said gun, b) electronic circuitry capable of changing low voltage direct current into said energizing pulses based upon control signals produced by either the timing of paint balls entering said chamber or the detection of the presence of a single paint ball within said chamber, c) a power supply which supplies D.C. current of 1.5 to 18 volts to said electronic circuitry, and d) a manually operated electrical switch trigger for activating said electronic circuitry.

In a preferred embodiment, said electronic circuitry further includes selector means for determining the number of paint balls to be fired with each depression of the switch trigger.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
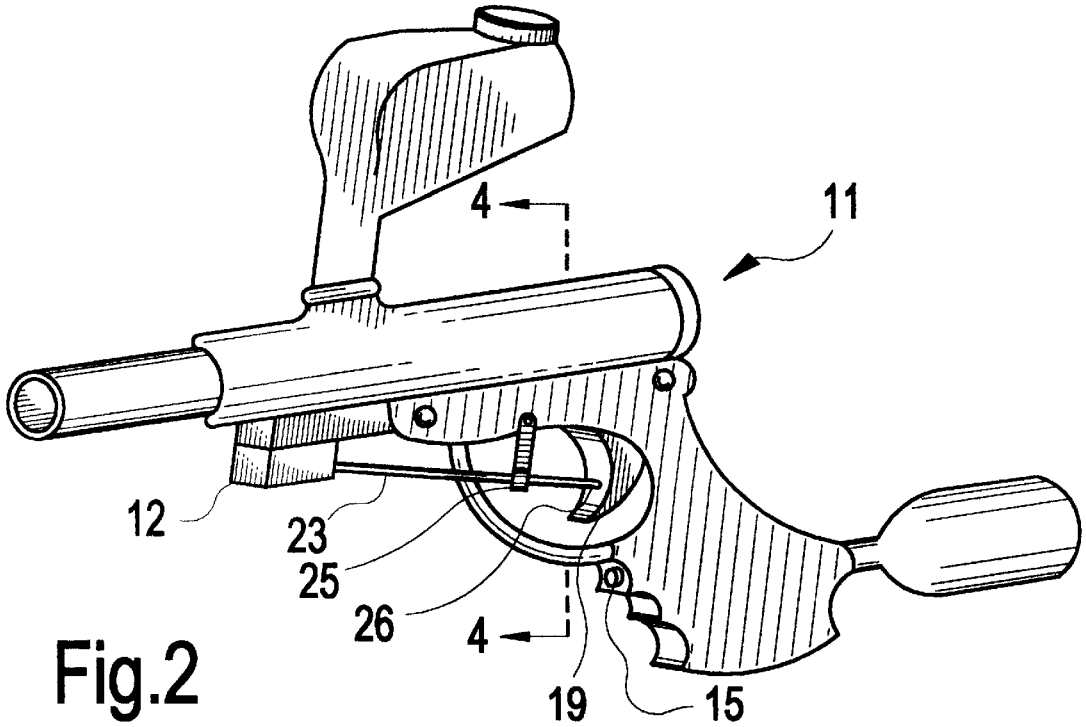
FIG. 2 is a perspective side view of the gun of FIG. 1 shown in operative association with a second embodiment of the control system of the present invention.
Figure 3:
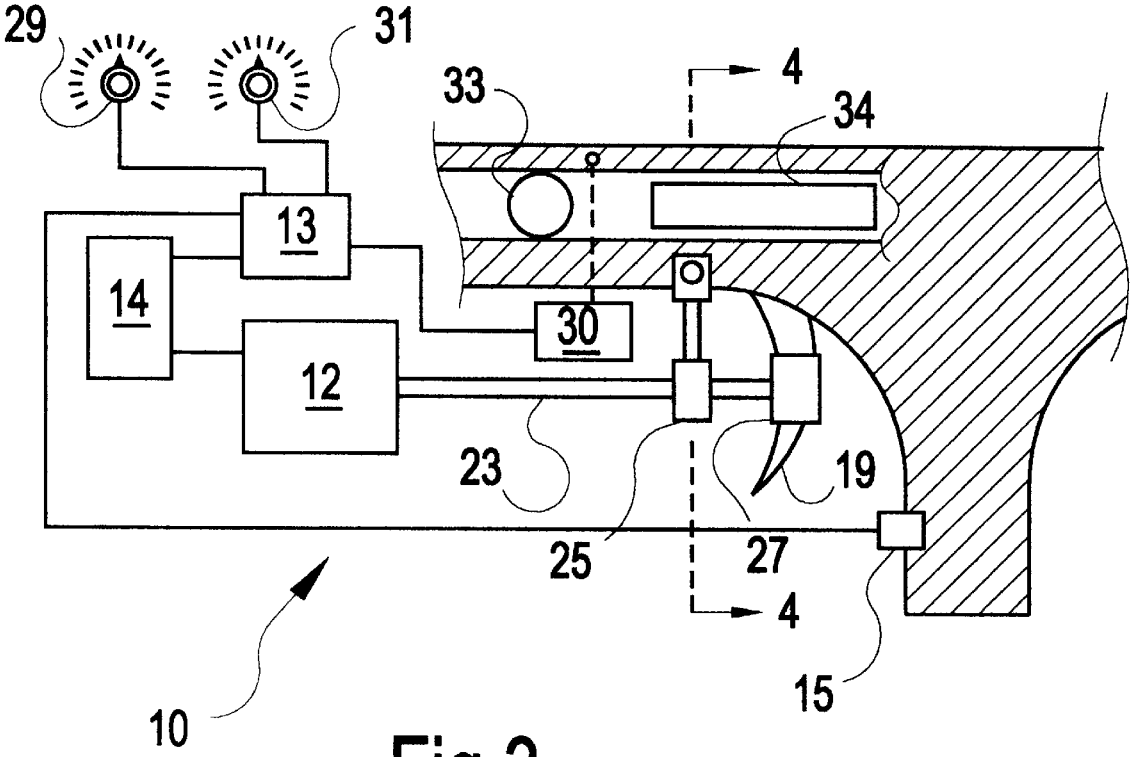
FIG. 3 is a schematic view of the second embodiment of the control system of this invention.
Figure 4:
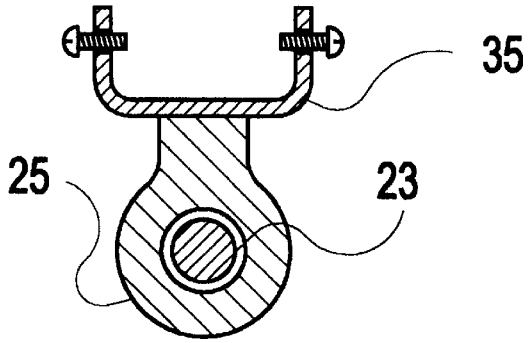
FIG. 4 is a sectional view taken in the direction of the arrows upon the line 4—4 of FIG. 3.

Referring now to FIGS. 2–4 a preferred embodiment of the control system 10 of the present invention is shown mounted upon the underside of gun 11 and comprised of an EMD 12, electronic circuitry denoted schematically by box 13, a battery 14, and electrical switch trigger 15.

The illustrated gun is comprised of a forestock 22 which supports barrel 16, receiver portion 17 located at the rear extremity of said barrel, magazine 18, conventional trigger 19 with associated pistol grip 20, and shoulder stock 21 which contains a compressed propellant gas.

The EMD is intended to produce reciprocating linear movement of a push rod 23. The EMD may be a solenoid, either of an in-line type or clapper or rotary type. Alternatively, the EMD may be a servo type device using an arm, lever or gear system to activate rod 23. All such devices are characterized in that a pulse of electrical energy produces a controlled mechanical force, and the discontinuation of said pulse either produces a reverse force or permits interaction of a reverse force such as may be produced by a spring-biased conventional trigger.

The EMD may be secured to forestock 22 by brackets or removable fastening means. A push rod 23, extending from said EMD is slideably positioned by guide 25 mounted by bracket 35 beneath receiver portion 17. In those embodiments wherein the EMD is a solenoid, guide 25 may not be required. The length of rod 23 and its positioning by guide 25 is such as to cause the distal extremity 26 of rod 23 to contact trigger 19. Said distal extremity may be equipped with coupling means such as harness 27 which facilitates the rearward pushing and possible forward pulling of trigger 19. In other embodiments, said coupling means may facilitate only a rearward pushing effect.

Electronic circuitry 13, generally housed within a protective enclosure, may be mounted on the gun or within the forestock, pistol grip or shoulder stock, but can be remotely associated with the gun. Said circuitry is comprised of commonplace components, arranged for example in the manner disclosed in U.S. Pat. Nos. 5,413,083; 5,727,538; and 4,770,153. One of the primary functions of said electronic circuitry is to convert a DC current of 1.5 to 18 volts into a regulated pulse current, said pulses serving as activation signals which energize said EMD.

In one embodiment of the present invention, said electronic circuitry contains an adjustable timer, and produces a timed sequence of said energizing pulses. For example, the timer may be adjusted so that the energizing pulses may be of 0.05 to 1.0 second duration, and may be spaced apart, namely the "off" cycle, between 0.05 and 1.0 second. In this embodiment, the gun can be caused to fire at the fastest rate imposed by mechanical factors.

Said electronic circuitry is preferably provided with a logic chip/circuit that provides an adjustable counter. Adjusting means, represented by knob 29 is interactive with said circuitry so that the number of energizing pulses in a single depression of trigger 19, or "firing" can be incrementally selected up to about 10. This means that each time trigger 19 is moved by rod 23 a selected number of paint balls will be fired.

Electrical switch trigger 15 is positioned preferably on pistol grip 20 adjacent trigger 19. In the operation of the control system of this invention, the shooter depresses electrical switch trigger 15 in order to activate the control system and initiate firing. Said electrical switch trigger 15 is essentially an on/off electrical switch, and is connected by suitable conductor wires to the other components of the system. If for some reason the control system of this invention fails, the shooter can still use the gun by resorting to manual depression of trigger 19.

Battery 14 is connected by suitable wiring to the other components of the system, and may be remote from the gun, as in the shooter's pocket. Said wires, or equivalent conductor means may be exterior of the gun or may be concealed within the forestock and pistol grip portions of the gun.

In another embodiment of the control system of the present invention, a sensor 30 is incorporated into the electronic circuitry to ascertain when a paint ball is properly seated within the firing chamber. It then tells the logic circuit that firing is permissible, namely it permits delivery of the energizing pulse to the EMD. Said sensor may be of commonplace design, and may involve infrared, photoelectric, proximity, density, capacitance or beta ray principles of operation.

When electrical switch trigger 15 is pressed it activates the sensor. If there is a paint ball in the chamber the sensing beam is "broken" or "on", and the gun fires. At the end of the cycle, for a fraction of a second that it takes for the next successive paint ball 33 to fall into the chamber, the beam is unbroken, and the gun will not fire. As soon as the next pain ball "breaks" the beam by virtue of being properly seated within the chamber, the logic circuit is activated, sending an energizing pulse to the EMD, and the gun will fire in the selected mode. Such manner of operation also reduces the incidence of chopped paint balls that would otherwise occur when a paint ball is not properly seated within the chamber, and the bolt 34 severs it.

A fire mode selector 31 is interactive with the electronic circuitry to select firing modes wherein the gun will fire a single shot, a burst of predetermined number of shots, or full automatic with just a single pressing and holding of electrical trigger switch 15. In the fully automatic firing mode, most guns will be able to shoot between about 5 to 15 paint balls per second. For example, if a particular gun is capable of loading into the chamber 10 paint balls per second, if the fire mode selector is set to 8 cycles per second, then when switch trigger 15 is pressed and held, the gun will shoot in full automatic mode at a rate of 8 shots per second with minimization of chopping of paint balls. The firing is controlled in the aforesaid manner either by the timing of paint balls entering the chamber, or the detection of a properly seated ball in the chamber.

Figure 1:
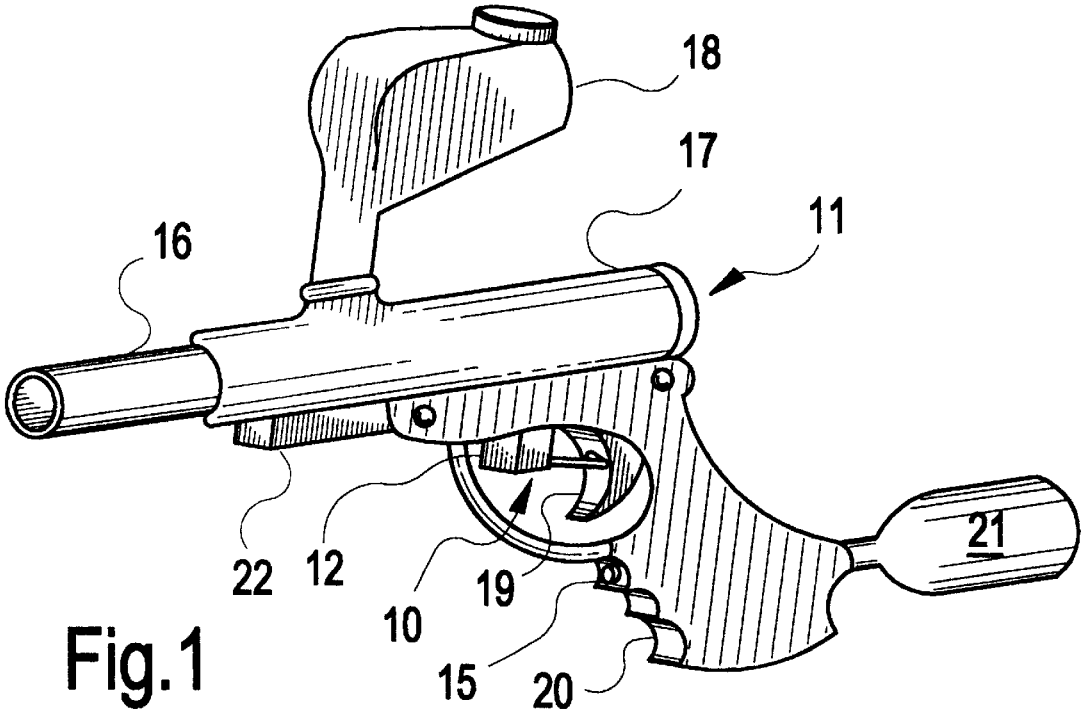
FIG. 1 is a perspective side view of a first embodiment of the control system of the present invention installed onto a paint ball gun of typical prior art design.
Figure 5:
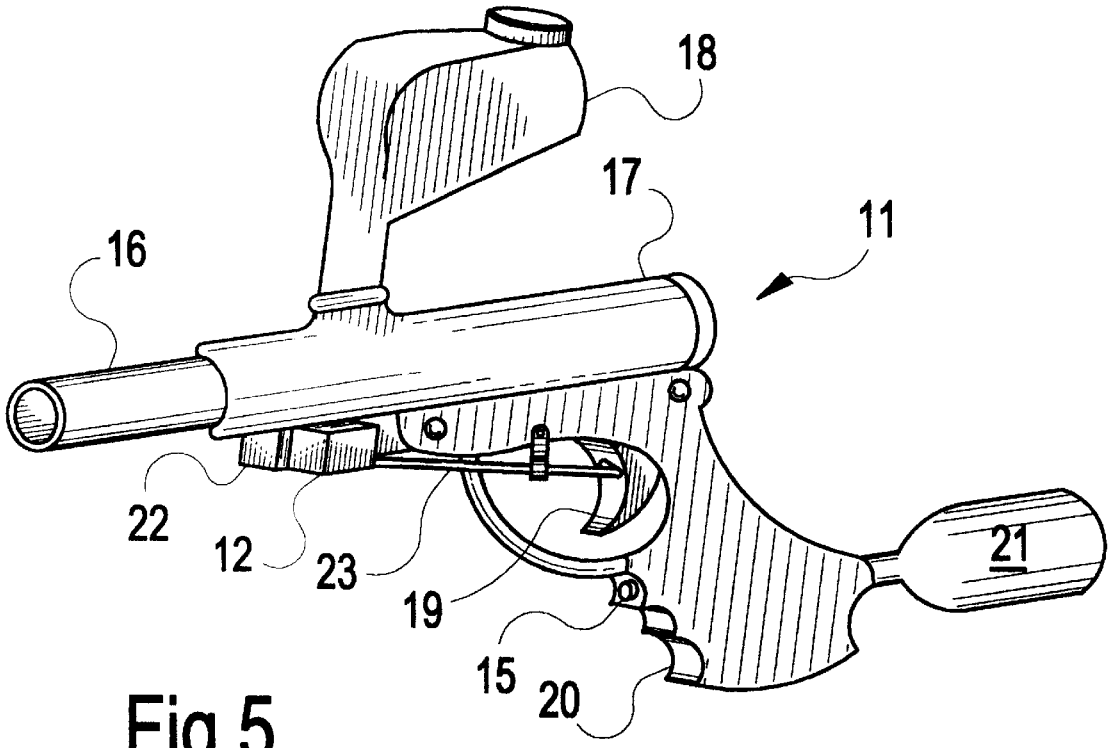
FIG. 5 is a perspective side view of the gun of FIG. 1 shown in operative association with a third embodiment of the control system of this invention.
Figure 6:
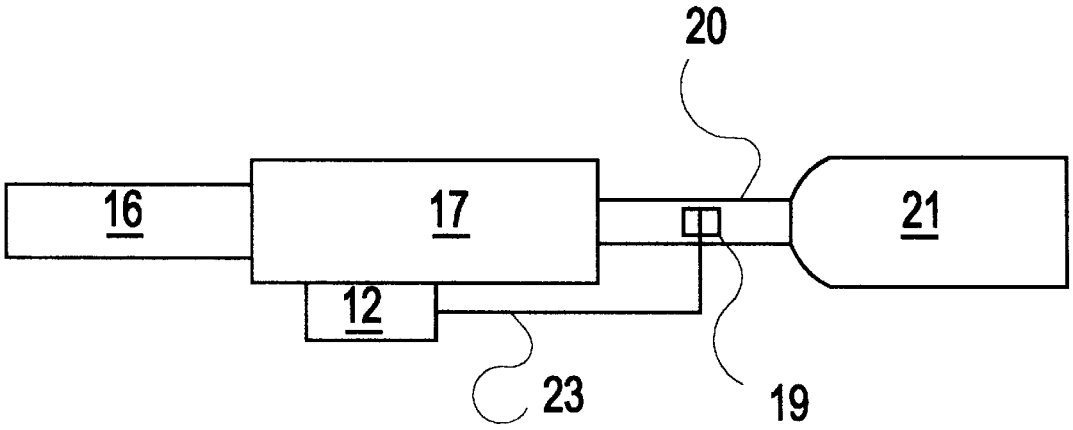
FIG. 6 is a schematic plan view of the embodiment of FIG. 5.

In the first embodiment of the firing control system of the present invention shown in FIG. 1, the EMD is located closely adjacent trigger 19. In the third embodiment shown in FIGS. 5 and 6, the EMD 12 is mounted upon the side of forestock 22 instead of below it. Accordingly, push rod 23 will have an angled configuration in order to properly engage trigger 19.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A system for controlling the firing of a paint ball gun having a forestock, a firing chamber, a conventional trigger, and a gripping portion adjacent said trigger, said system comprising:

a) an electromechanical device (EMD) that produces linear reciprocating motion responsive to energizing pulses of electrical current, and adapted to actuate said conventional trigger to actuate the firing of said gun, b) electronic circuitry capable of changing low voltage direct current into said energizing pulses based upon control signals produced by either the timing of paint balls entering said chamber or the detection of the presence of a single paint ball within said chamber, c) a power supply which supplies D.C. current of 1.5 to 18 volts to said electronic circuitry, and d) a manually operated electrical switch trigger for activating said electronic circuitry.

2. The firing control system of claim 1 wherein said electrical switch trigger is manually operated by way of depression.

3. The firing control system of claim 2 further comprising selector means for determining the number of paint balls to be fired with each depression of said electrical switch trigger.

4. The firing control system of claim 3 wherein said EMD is a solenoid.

5. The firing control system of claim 2 wherein said electrical switch trigger is an on/off electrical switch.

6. The firing control system of claim 1 wherein said EMD is mounted upon said gun beneath said forestock.

7. The firing control system of claim 1 wherein said EMD is mounted upon said gun on a side of said forestock.

8. The firing control system of claim 1 wherein a push rod extends between said EMD and conventional trigger.

9. The firing control system of claim 1 wherein said electronic circuitry includes an adjustable timer, and produces a timed sequence of said energizing pulses.

10. The firing control system of claim 9 wherein said energizing pulses are of 0.05 to 1.0 second duration, and are spaced apart in said sequence by between 0.05 and 1.0 second.

11. The firing control system of claim 9 further comprising a logic chip circuit that provides an adjustable counter.

12. The firing control system of claim 11 further having adjusting means interactive with said logic chip circuit so that the number of energizing pulses in a single firing can be incrementally selected up to about 10.

13. The firing control system of claim 1 wherein a sensor is included within said electronic circuitry to detect the proper seating of a paint ball within said firing chamber.

14. The firing control system of claim 13 wherein, when said sensor confirms the presence of a paint ball within said firing chamber, the deliverance of an energizing pulse is permitted, and when the presence of a paint ball within said firing chamber is not confirmed, the deliverance of an energizing pulse is not permitted.

* * * * *